US006612127B2

(12) United States Patent
Simmons

(10) Patent No.: US 6,612,127 B2
(45) Date of Patent: Sep. 2, 2003

(54) PORTABLE REFRIGERATION TABLE WITH ELEVATING AND SUPPORTING DIVIDERS

(76) Inventor: Jesse K. Simmons, 4030 Sleeth Rd., Milford, MI (US) 48382

( * ) Notice: Subject to any disclaimer, the term of this patent is extended or adjusted under 35 U.S.C. 154(b) by 0 days.

(21) Appl. No.: 10/034,615

(22) Filed: Dec. 27, 2001

(65) Prior Publication Data

US 2003/0121277 A1 Jul. 3, 2003

(51) Int. Cl.[7] ..... F25D 3/08
(52) U.S. Cl. ..... 62/457.2; 62/459
(58) Field of Search ..... 62/457.2, 457.7, 62/459, 371, 372, 463, 464, 465; 220/592.01, 592.03, 592.16

(56) References Cited

U.S. PATENT DOCUMENTS

| | | | | |
|---|---|---|---|---|
| 4,307,581 A | | 12/1981 | Reid | 62/457 |
| 4,375,758 A | | 3/1983 | Simmons | 62/457 |
| 4,424,687 A | | 1/1984 | Morgan | 62/457 |
| 4,515,421 A | | 5/1985 | Steffes | 312/351 |
| 4,565,074 A | | 1/1986 | Morgan | 62/457 |
| 4,574,594 A | | 3/1986 | Simmons et al. | 62/457 |
| 4,724,682 A | | 2/1988 | Flum et al. | 62/462 |
| 4,739,580 A | | 4/1988 | Simmons et al. | 47/17 |
| 4,787,532 A | | 11/1988 | Borjesson | 220/410 |
| 5,052,184 A | | 10/1991 | Jarvis | 62/60 |
| 5,052,185 A | | 10/1991 | Spahr | 62/60 |
| 5,307,647 A | | 5/1994 | McClure | 62/371 |
| 5,353,607 A | | 10/1994 | McBride | 62/457.7 |
| 5,437,165 A | | 8/1995 | White et al. | 62/465 |
| 5,551,558 A | | 9/1996 | Bureau | 206/223 |
| 5,596,880 A | | 1/1997 | Welker et al. | 62/372 |
| 5,605,056 A | | 2/1997 | Brown et al. | 62/457.4 |
| 5,636,524 A | | 6/1997 | Woods et al. | 62/459 |
| 5,655,460 A | | 8/1997 | Boonstra | 108/55.3 |
| 5,701,757 A | | 12/1997 | Heverly | 62/457.2 |
| 5,730,282 A | * | 3/1998 | Bureau | 206/223 |
| 5,931,019 A | | 8/1999 | White et al. | 62/457.7 |
| 6,067,810 A | | 5/2000 | Jennings et al. | 62/246 |
| 6,085,535 A | | 7/2000 | Richmond et al. | 62/258 |
| 6,105,654 A | | 8/2000 | Martel | 160/135 |
| 6,126,124 A | | 10/2000 | Wagner | 248/127 |
| 6,244,064 B1 | | 6/2001 | Powell et al. | 62/457.2 |

* cited by examiner

*Primary Examiner*—Chen Wen Jiang
(74) *Attorney, Agent, or Firm*—Gifford, Krass, Groh, Sprinkle, Anderson & Citkowski, P.C.

(57) ABSTRACT

A portable refrigeration table for displaying, in elevated and supported fashion, a plurality of items. The table includes a body having a substantially rectangular shaped and planar base surface, a plurality of elevated and interconnecting sides defining a basin therebetween and which is capable of holding a volume of ice particulates. A plurality of first, second, third and fourth associated edge locations of the body and are capable of being pivoted between a first locking position and a second unlocking position in which the legs may be pivoted to a folded position against the body. A plurality of elongated dividers are arranged in upwardly extending fashion from the planar base surface, each of the dividers terminating in an upwardly facing surface capable of supporting the items at locations above the planar base surface. Wherein the elevating members maintain the items at an elevation above a water level created within the basin and upon the base surface, the water level resulting from melting of the ice particulates.

13 Claims, 4 Drawing Sheets

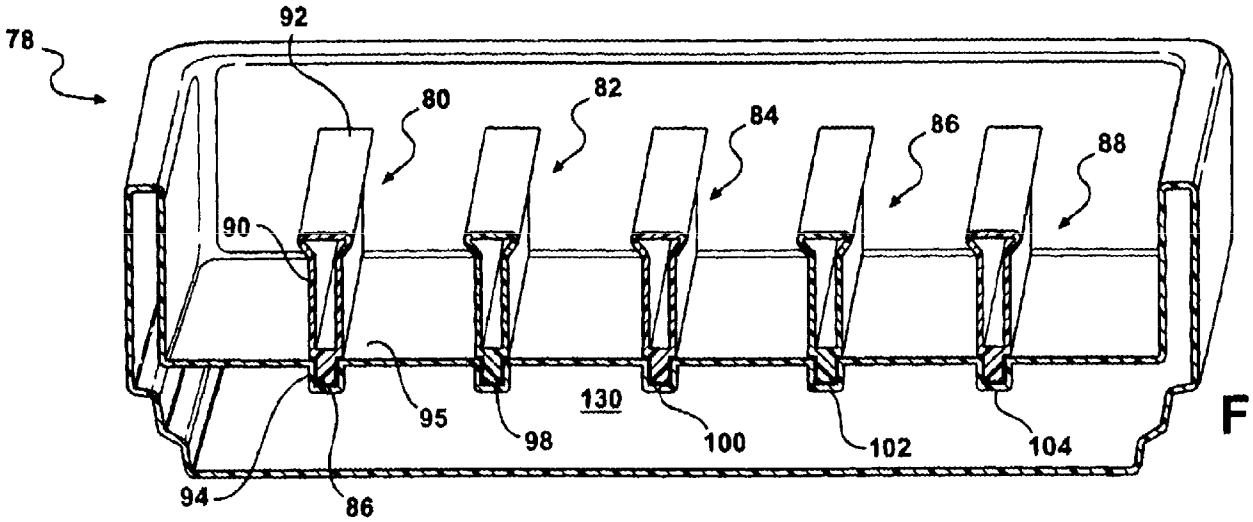
FIG - 5
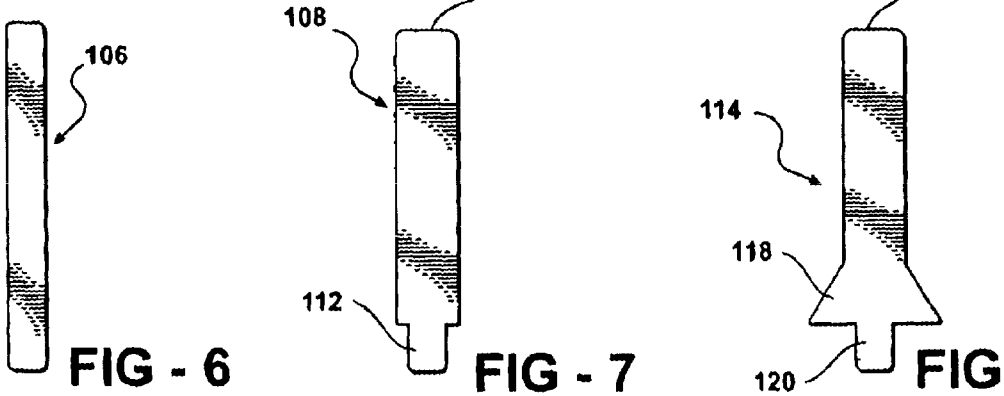
FIG - 6
FIG - 7
FIG - 8
FIG - 9

PORTABLE REFRIGERATION TABLE WITH ELEVATING AND SUPPORTING DIVIDERS

BACKGROUND OF THE INVENTION

1. Field of the Invention

The present invention relates generally to portable and elevating table supports for use with volumes of ice to maintain, in a substantially refrigerated condition, items such as food and beverage. More specifically, the present invention discloses an improved portable refrigeration table incorporating a plurality of insertable dividers and which, in combination with a volume of ice (such as cubes) placed in an open basin defined within the table, elevates and supports the various items at a location above a melted water level created by the ice.

2. Description of the Prior Art

The prior art is fairly well documented with examples of ice table supports, the purpose for which being to maintain, in a substantially refrigerated and displayed condition, items such as food and beverage. A further preferred application of such tables is in making them portable and reference is first made to U.S. Pat. Nos. 4,574,594 and 4,739,580, both issued to Simmons and which teach variations of such portable refrigeration tables having frictionally engaging leg locking mechanisms.

The Simmons U.S. Pat. No. 4,574,594 reference teaches in particular an ice table platform defining a recessed dry storage compartment and a recessed ice storage compartment. A threaded orifice separates the two compartments and for selectively storing or permitting the draining of water from the ice storage compartment. The ice table further includes supporting members fixedly secured to the bottom of the platform (capable for supporting upon a table surface) and the table further includes legs pivotably secured to the platform for in turn supporting the platform upon a floor surface. The legs are further provided with retractable locking rings which frictionally engage the supporting member to secure the leg into position.

Simmons U.S. Pat. No 4,739,580 is a related patent U.S. Pat. No. 4,574,594 and further discloses a plurality of insertable and dividing trays which are capable of being installed within a substantially open interior of the table. In this fashion, the table may be utilized as a greenhouse by adding a specially adapted cover or as a warming table by including food trays and associated burners.

A yet further example of a portable ice table is set forth in U.S. Pat. No. 4,375,758, also issued to Simmons, and which teaches a platform constructed of light-weight material and with an outer insulated surface and a removable insulating cover. As with the U.S. Pat. No. 4,574,594 reference, the platform includes a handle, a recessed dry storage compartment, a recessed ice storage compartment separated from the dry storage compartment, a threaded and interconnecting orifice separating the compartments, and pivotally associated legs. Openings are further defined in an ice supporting surface of the ice storage compartment and which permit the drainage of water to a second and underlying section.

Additional examples of the prior art include U.S. Pat. Nos. 4,424,687 and 4,565,074, both issued to Morgan, and each of which teach an ice tray or rack for use with a portable ice chest. Morgan '074 teaches a substantially horizontal tray with slots or openings defined therein and further includes a set of feet which support the horizontal member in an elevated position. Morgan '687 patent discloses a horizontal planar member having a number of slots or openings formed therein and a set of feet which support the planar member in an elevated position. An alternative variant describes two portions jointed together, one of which includes a set of hollow legs which receptacles defined within and which seatingly engages opposing tabs extending from the other portion.

Similar types of inserts, provided for use with a cooler, include a removable perforated tray for coolers, as set forth in U.S. Pat. No. 6,126,124, issued to Wagner. The Wagner reference teaches a removable and perforated tray constructed of a plurality of interconnecting horizontal and vertical ribs, whereby spaces are created between interconnections of adjacent horizontal and vertical ribs. Peripheral collars extend through large openings in the tray and each have a support leg extending outwardly therefrom for supporting the tray in the desired elevated position.

Finally, U.S. Pat. No. 5,052,184, issued to Jarvis, teaches a cooler chest grid and method and which discloses a screened grid sized and shaped to fit inside a cooler chest. Doors formed in the screened grid are provided for accessing sealed beverage containers storable under the screen grid in ice water, while at the same time keeping dry or unsealed food items positionable atop the screen grid. Cubed ice is poured or packed around and on top of the food items and, as the ice melts, the resulting water drops below grid and in order to cool the sealed beverage containers stored below the grid.

SUMMARY OF THE PRESENT INVENTION

The present invention is an improved portable refrigeration table incorporating a plurality of insertable dividers and which, in combination with a volume of ice (such as cubes) placed in an open basin defined within the table, elevates and supports the various items at a location above a melted water level created by the ice. This advantage permits the food items to remain substantially immersed within the volume of ice cubes, while at the same time providing a more convenient and simplified arrangement for retaining the items in elevated position above the melted water and for maximizing the chilling effect provided by the refrigeration table.

The refrigeration table includes a body having a substantially rectangular shaped and planar base surface. The body is preferably constructed of an injection molded, flowable and plasticized material and further include a plurality of elevated and interconnecting sides defining a basin therebetween which is capable of holding a volume of ice particulates.

A plurality of members are secured to the body and extending downwardly therefrom. In the preferred embodiment, the members further define a first, second, third and fourth legs extending from locations proximate first, second, third and fourth associated edges defined along the body, the legs further being capable of being pivoted between a first locking position and a second unlocking position in which an associated leg may be pivoted to a folded position against the body.

A plurality of elevating members are arranged in upwardly extending fashion from the planar base surface. In a first preferred variant, each of the elevating members include an elongate extending divider, typically extending between associated sides of the body, and terminating in an upwardly facing surface capable of supporting the refrigerable items at locations above the planar base surface. In this variant, the planar base surface further includes any number of recessed slots or channels defined therein, for receiving downwardly extending and inserting ends of each of the dividers.

In a further preferred variant, the elevating members are incorporated into a typically thermoformed and removable mat dimensioned to fit upon the planar base surface, the mat further capable of exhibiting any desired configuration and such as which may further incorporate a substantially "egg-carton like" appearance for supporting the refrigerable items in upwardly distanced fashion from a water level created within the basin and resulting from melting of the ice particulates.

BRIEF DESCRIPTION OF THE DRAWINGS

Reference will now be made to the attached drawings, when read in combination with the following detailed description, wherein like reference numerals refer to like parts throughout the several views, and in which:

FIG. 5 is a view in side cutaway of a further variant of the portable refrigeration table and which includes individual elongate and installable dividers installable upon a dimensioned base surface of the table according to a further preferred variant of the present invention;

FIG. 6 is a cross sectional view of a further selected divider according to the present invention;

FIG. 7 is a cross sectional view of a third selected divider according to the present invention;

FIG. 8 is a cross sectional view of a fourth selected divider according to the present invention;

FIG. 9 is a cross sectional view of a fifth selected divider according to the present invention.

DETAILED DESCRIPTION OF THE PREFERRED EMBODIMENTS

Figure 1:
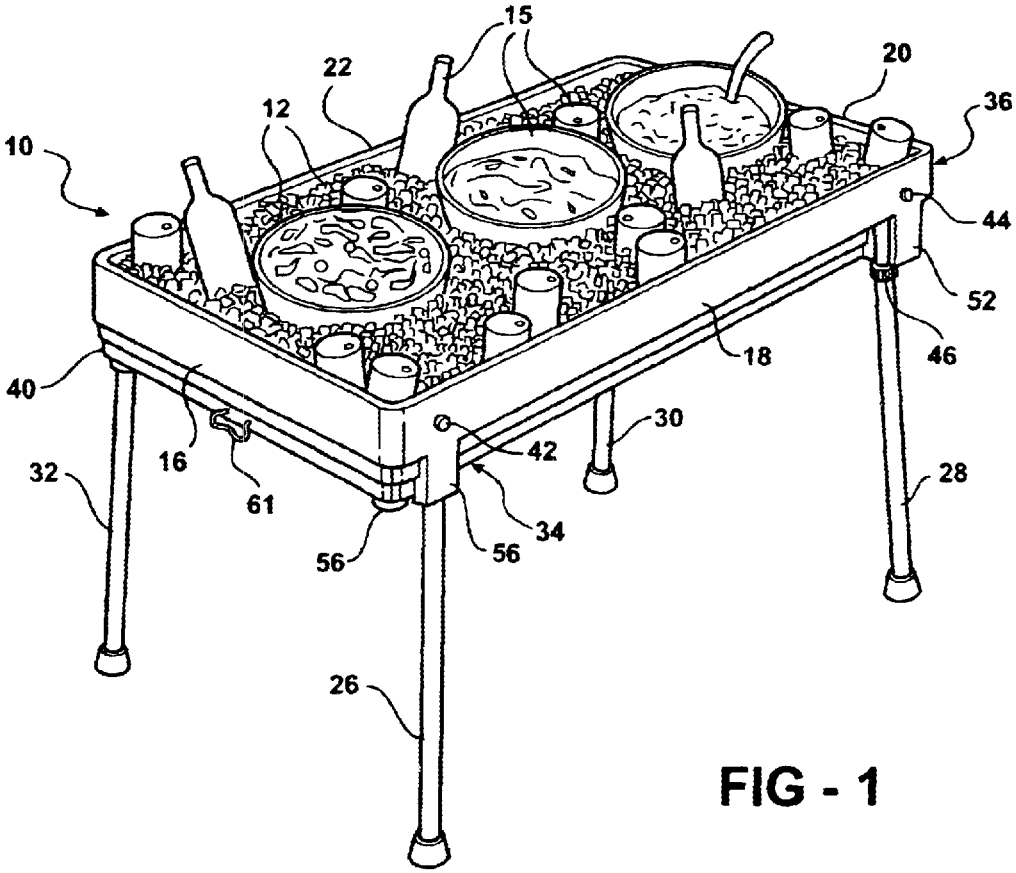
FIG. 1 is an operative view, in perspective, of the portable refrigeration table according to the present invention.
Figure 2:
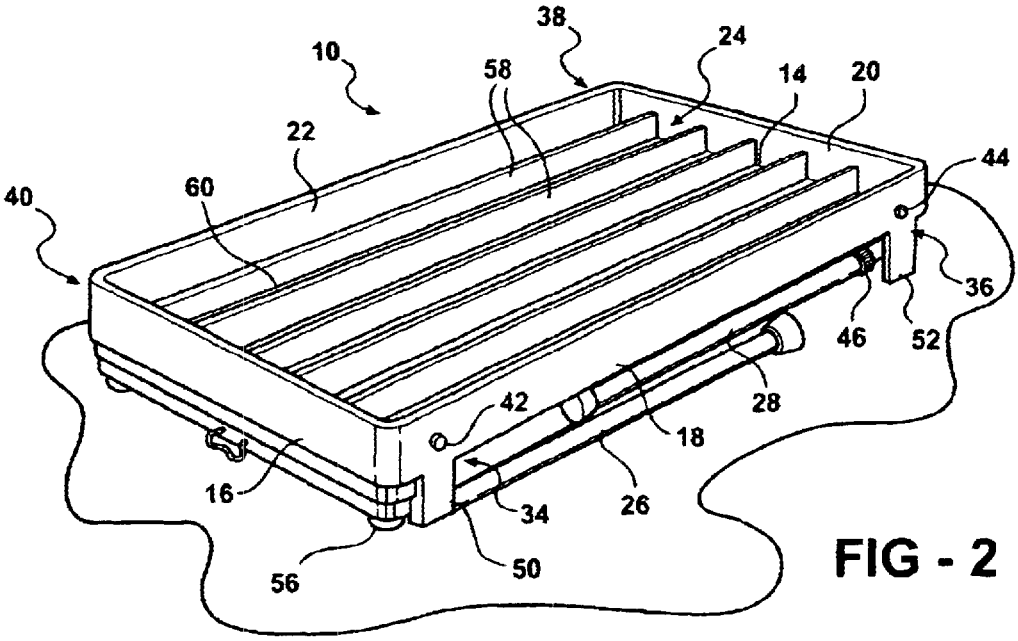
FIG. 2 is a further perspective of the portable refrigeration table and illustrating both the foldable aspects of its legs as well as general configuration created by the dividers incorporated within the open basin of the refrigeration table according to the present invention.

Referring now to FIGS. 1 and 2, an improved portable refrigeration table is illustrated at 10 according to the present invention. As previously described the table 10, in combination with a volume of ice, such as particulates (ice chips, blocks, cubes, etc.) 12, placed in an open basin defined within the table, elevates and supports the various items at a location above a melted water level 14 (see in particular FIG. 3) created by the ice. The advantage permits the food items 15 (including typically both beverage and container items) to remain substantially immersed within the volume of ice cubes, while at the same time providing a more convenient and simplified arrangement for retaining the items in elevated position above the melted water.

Referring again to the drawing figures, the refrigeration table 10 includes a body having a substantially rectangular shaped and planar base surface 14. The body is preferably constructed of an injection molded, flowable and plasticized material, having suitable thermal insulating properties, and further include a plurality of elevated and interconnecting sides 16, 18, 20 and 22 defining a basin (see generally at 24) therebetween and which is capable of holding the volume of ice particulates 12. While illustrating a generally rectangular shaped table 10, it is understood that any suitable configuration can be employed, such as a hexagonal or octagonal table, and within the scope of present invention.

A plurality of elongated members are secured to the body and extending downwardly therefrom. In the preferred embodiment, the members further define first 26, second 28, third 30 and fourth 32 legs extending from locations proximate first 34, second 36, third 38 and fourth 40 associated edges defined along the body 10.

Figure 4:
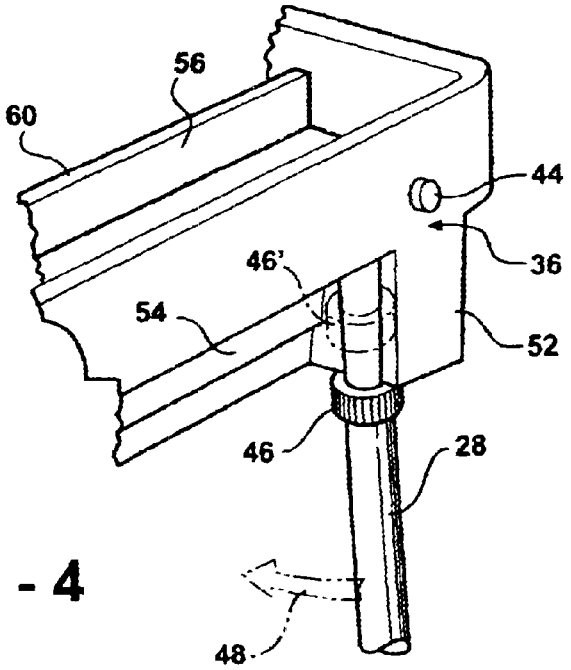
FIG. 4 is a sectional view in perspective of a selected leg locking mechanism and further illustrating the manner in which the leg is pivotally rotated from an open position to a closed and folded position.

Referring further to the enlarged sectional perspective of FIG. 4, the second leg 28, extending from the second associated edge 36 of the table 10, is again illustrated. According to the present invention, the legs 26–32 are further being capable of being pivoted between a first locking position (FIG. 1) and a second unlocking position in which an associated leg may be pivoted to a folded position (FIG. 2) against the body 10.

The pivoting relationship is made possible through the provision of a crosswise extending and mounting pin for pivotally securing each of the legs to its associated edge location of the body. Reference is particularly made to first pin 42 (associated with first leg 26) and second pin 44 (associated with second leg 28). The remaining pins for third and fourth legs 30 and 32 are hidden from view but are understood to also exist.

Each of the legs, with exemplary reference being made again to second leg 28 in FIG. 4, further includes a locking ring, see at 46, which is secured in axially translatable fashion along the exterior facing surface of the associated leg and proximate its upper end. As further evidenced by the illustrated detail in FIG. 4, the locking ring translates between a first locking position (see in phantom at 46') to a second (downwardly translated) and unlocking position (again at 46) and in which the associated leg 28 may be pivoted (see along directional arrow 48) to its substantially folded position against the body underside of the portable table (see again FIG. 2).

Additional features of the leg locking and folding mechanism include downwardly extending leg support portions, such as at 50 for first associated edge 34 and at 52 for second associated edge 36. The leg support portions, referencing particularly that shown again at 52 in the enlarged sectional view of FIG. 4, provide some degree of support to the associated leg 28.

As is also best shown in FIG. 4, the illustrated locking ring (in its phantom position 46') may also abut against an underside extending rail portion (see at 54) of the table underside and in order to abuttingly engage the table leg in place. In the alternative, other conventional and suitable frictional engaging mechanisms can be employed and it is also contemplated that the legs may be removed in their entirety and the base of the unit be placed upon edge pad supports, see by example at 56 for first associated edge location 34; it further being understood that a corresponding pad support is located proximate each edge location of the base underside and in order to support the unit upon an existing serving table or other suitable elevated support.

Referring again to FIG. 2, a plurality of elevating members 58 are generally illustrated in a first preferred variant and which are arranged in upwardly extending fashion from the planar base surface 14. As will be now explained, the elevating members according to the present invention may be provided in a wide arrangement of shapes, sizes and configurations the common advantage of which being to maintain the refrigerable items 15 in supported and elevated locations above a water level 60 (see FIG. 3) created by the melting of the ice particulates 12. Along these lines, and referring again to FIG. 1, a drain cock 61 is located along a perimeter edge of the body (see at a substantially underside location and along first side 16). Removal of the drain cock 61 (usually consisting of a plug or other suitable type of sealing portion) causes the water level 60 to drain from the refrigeration table and, along these lines, it is desirable to place a bucket or other fluid retaining container in proximity to the drain cock when emptying the fluid contents from the table.

A common aspect of the elevating members according to the preferred variants disclosed herein, and such as again is illustrated at 58 in FIG. 2, is that each includes an elongate extending divider, typically extending between associated sides of the body, and terminating in an upwardly facing surface (see at 60 in FIG. 2) capable of supporting the refrigerable items at locations above the planar base surface.

Figure 3:
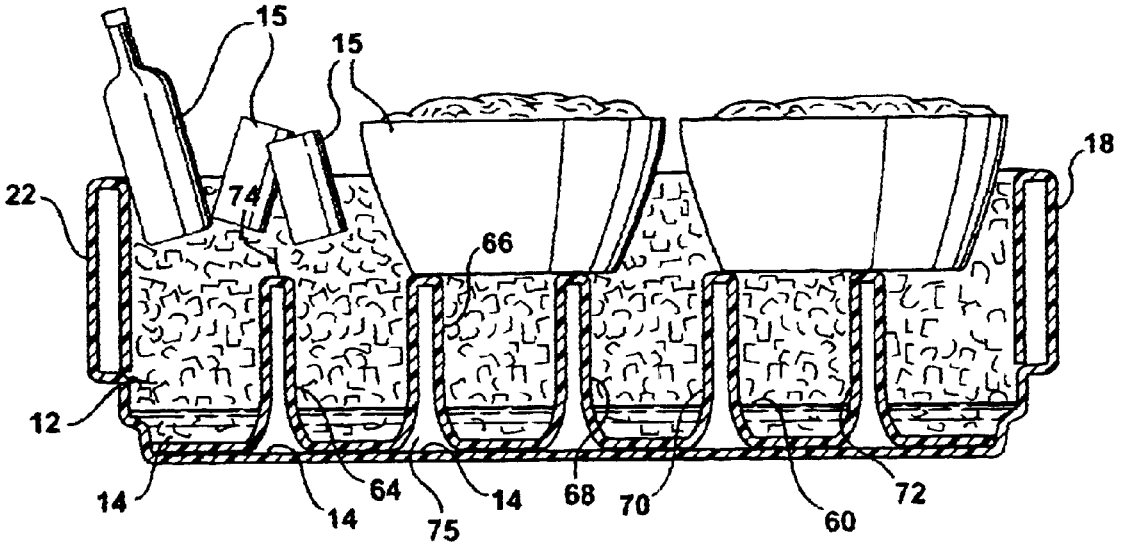
FIG. 3 is a side cutaway view of the refrigeration table and illustrating, according to a preferred variant, a removable insert incorporating the dividers.
Figure 3A:
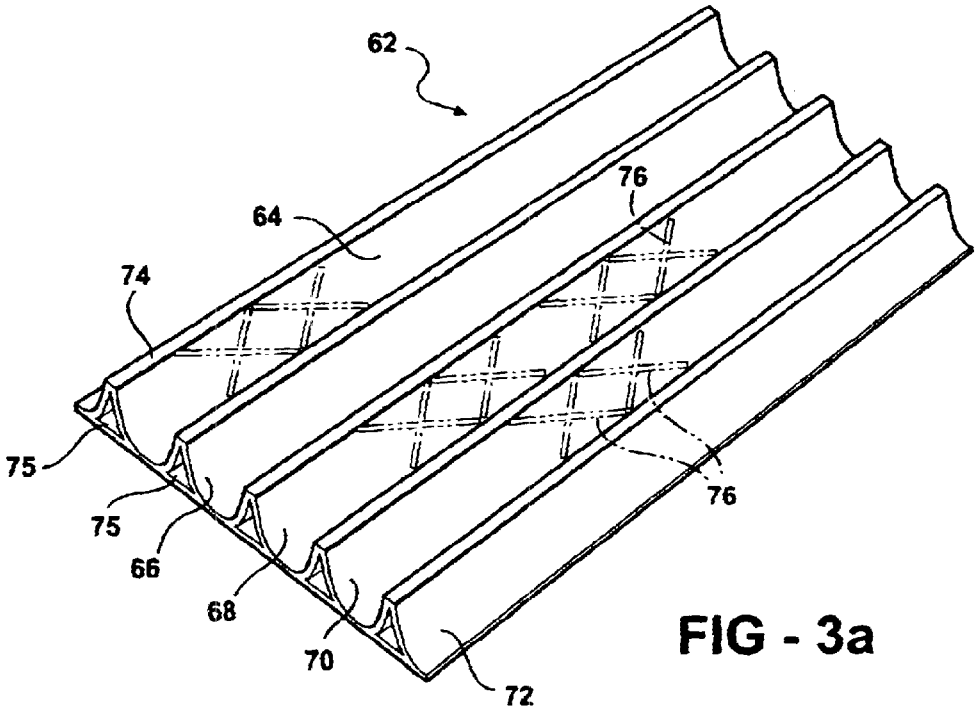
FIG. 3*a* is a sectional view of the removable insert illustrated in FIG. 3.

In the preferred variant of FIGS. 3 and 3*a*, the elevating members are incorporated into a typically rubber/plasticized, thermoformed and removable mat 62 (FIG. 3*a*) which is dimensioned to fit upon the planar base surface 24, defined between the upwardly extending sides 16, 18, 20 and 22. The mat 62 may constructed in any suitable configuration, such as which includes a plurality of individual, interconnected, and elongate extending divider portions 64, 66, 68, 70, and 72, each of which further exhibiting a suitable upwardly facing surface, see at 74 by example for elongated divider portion 64.

The thermoformed mat 62 can be produced from a desired rubberized, plasticized or hybrid material and in order to provide desired characteristics of durability, flexibility in insertion and removal to and from within the basin defined within the refrigeration table. In this manner, the mat 62 can be laid in and quickly retrieved from upon the basin defined within the refrigeration table. Thermoforming also provides the ability to save material in construction, such as by created pockets or recesses (see at 75) for each of the divider portions and to contribute to creating the desired flexible and resilient characteristics of the mat 62. Referring again in particular to FIG. 3*a*, the ability to produce a mat 62 from such as thermoforming process also makes possible the ability to incorporate any desired configuration into the mat, such as three dimensional and webbed configurations (shown in phantom at 76) and which defines a substantially "egg-carton like" appearance for supporting the refrigerable items in the desired fashion and, as again with any of the disclosed variants, from a water level created within the basin and resulting from melting of ice particulates which surround both the inserted items (see again at 15 in FIG. 3) as well as fill the cavities between the divider portions.

Referring to FIG. 5, a further preferred variant 78 of the present invention substitutes the lay-in mat arrangement of FIGS. 3 and 3*a* with the provision of a plurality of individual and insertable elongate extending dividers 80, 82, 84, 86, and 88. The dividers 80–88 are all illustrated in cutaway and, referring by example to the first selected divider 80, includes an interiorly hollowed and extending body 90 with upwardly facing and substantially enlarged support surface 92 and a downwardly extending and inserting end 94. As illustrated, each of the succeeding dividers 82, 84, 86 and 88 is constructed in substantially identical fashion.

The body of the refrigeration table, in particular the planar base surface 95, further exhibits a plurality of recessed and lengthwise extending channels, see at 96, 98, 100, 102 and 104. Each of the channels is defined by a three dimensional and substantially "U" shaped pocket defined in the base surface 95 and is dimensioned for suitably receiving the inserting end (see again by example at 94) of each of the dividers.

Referring further to FIGS. 6–9 in succession, additional variants are illustrated in cross section of selected divider members for engagement with the table body and these include a uniform cross sectional member such as illustrated at 106 in FIG. 6; a modified cross sectional member 108 in FIG. 7 having a rounded upper end 110 and a reduced section peg-fitting downward end 112; a further modified member 114 (FIG. 8) having again a rounded upper end 116 and enlarged and outwardly flared (dovetailed) portion 118 proximate the downwardly inserting and pegged end 12; and, finally, a yet further modified member 122 (FIG. 9) having outwardly flared dovetailed configurations at both the upper facing 124 and downwardly inserting 126 ends, as well as again a pegged downwardly extending portion 128 for engaging within the selected channel recess in the base surface 95.

Figure 10:
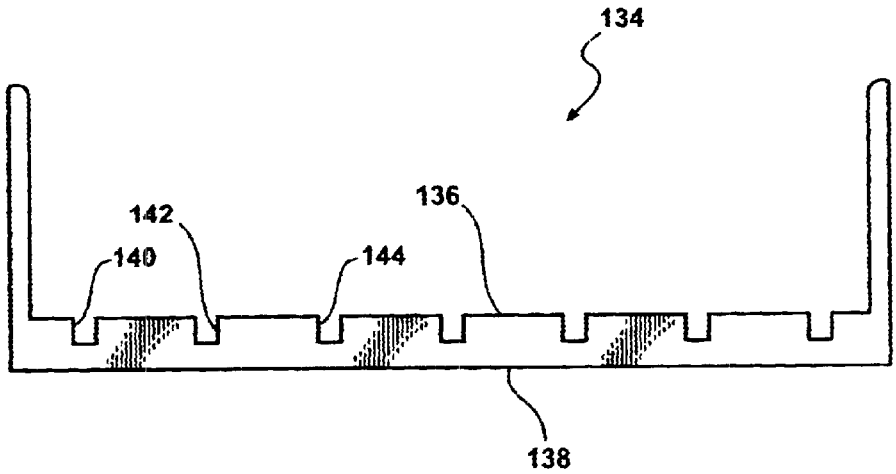
FIG. 10 is a view in side cutaway of a still further variant of the portable refrigeration table and which, in contrast to FIG. 5, includes a modified base surface for receiving the individual elongate and installable dividers according to the present invention.

Referring again to FIG. 5, the body of the variant 78 illustrated can also include a dimensioned interior with an interiorly open and subterranean portion 130 located underneath the base surface 95 and a bottom facing surface 132 of the body. Alternatively, and referring finally to FIG. 10, a yet further variant 134 of the body of the table contemplates substituting the interiorly opened and dimensioned configuration of the base surface with a solid bottom exhibiting both upwardly 136 and downwardly 138 facing surfaces. As with the disclosed variant of FIG. 5, a number of recessed channels 140, 142, 144, et. seq., may be provided within the base surface 136, for receiving any suitable elongated divider insert, and it is also envisioned that the "lay-in" mat configuration 62 may also be employed in substitution of the individual divider inserts in any of the preferred variants.

Having described my invention, additional preferred embodiments will become apparent to those skilled in the art to which it pertains and without deviating from the scope of the appended claims. In particular, it is also contemplated that the divider/item supporting members may also be provided as individual pegs or like shaped portions, each of which can fit within an associated and spaced apart aperture formed in the base support surface and in order to custom create a desired elevated support surface configuration.

Other and additional types of elevating and supporting structure, capable of being utilized with the portable refrigeration table and described herein, may also be employed within the scope of the present invention.

I claim:

1. A portable refrigeration table for displaying, in elevated and supported fashion, a plurality of items, said table comprising:

a body having a substantially planar base surface and a plurality of elevated and interconnected sides defining an open and interior basin therebetween which is capable of holding a volume of ice particles;

a plurality of elongated members secured to said body and extending downwardly therefrom; and a plurality of elevated members arranged in upwardly extending fashion from said planar base surface and to an elevated height within said open and interior basin, each of said elevating members terminating in a upwardly facing surface capable of supporting the items at locations above said planar base surface;

wherein said elevating members maintain the items at an elevation above a water level created within said basin and upon said base surface, the water level resulting from melting of the ice particulates.

2. The portable refrigeration table as described in claim 1, said elongated members further comprising a plurality of first, second, third and fourth legs extending from locations proximate first, second, third and fourth associated edges defined by said body.

3. The portable refrigeration table as described in claim 2, further comprising a pin for pivotally securing each of said legs to said body.

4. The portable refrigeration table as described in claim 2, each of said legs further comprising a locking ring secured in axially translatable fashion proximate an upper end thereof, said locking ring translating between a first locking position to a second unlocking position in which said associated leg may be pivoted to a folded position against said body.

5. The portable refrigeration table as described in claim 1, further comprising a drain cock located along a perimeter edge of said body and, upon being opened, permitting the draining of water from within said basin.

6. A portable refrigeration table for displaying, in elevated and supported fashion, a plurality of items, said table comprising:

a body having a substantially rectangular shaped and planar base surface, a plurality of elevated and interconnecting sides defining an open and interior basin therebetween and which is capable of holding a volume of ice particulates;

a plurality of elongated members secured to said body and extending downwardly therefrom, said members each further comprising a plurality of first, second third and fourth legs extending from locations proximate first, second, third and fourth associated edges defined by said body, said legs capable of being pivoted between a first locking position and a second unlocking position in which said associated leg may be pivoted to a folded position against said body; and a plurality of elevating members arranged in upwardly extending fashion from said planar base surface and to an elevated height within said open and interior basin, each of said elevating members further comprising an elongate extending divider extending between associated sides of said body and terminating in an upwardly facing surface capable of supporting the items at locations above said planar base surface;

wherein said elevating members maintain the items at an elevation above a water level created within said basin and upon said base surface, the water level resulting from melting of the ice particulates.

7. A portable refrigeration table for displaying, in elevated and supported fashion, a plurality of items, said table comprising:

a body having a substantially rectangular shaped and planar base surface, a plurality of elevated and interconnecting sides defining a basin therebetween and which is capable of holding a volume of ice particulates, said body further being constructed of an injection molded, flowable and plasticized material;

a plurality of elongated members secured to said body and extending downwardly therefrom, said members each further comprising a plurality of first, second, third and fourth legs extending from locations proximate first, second, third and fourth associated edges defined by said body, said legs capable of being pivoted between a first locking position and a second unlocking position in which said associated leg may be pivoted to a folded position against said body; and a plurality of elevating members arranged in upwardly extending fashion from said planar base surface, each of said elevating members further comprising an elongate extending divider extending between associated sides of said body and terminating in an upwardly facing surface capable of supporting the items at locations above said planar base surface, said elevating members further being incorporated into a removable mat dimensioned to fit upon said planar base surface;

wherein said elevating members maintain the items at an elevation above a water level created within said basin and upon said base surface, the water level resulting from melting of the ice particulates.

8. A portable refrigeration table for displaying, in elevated and supported fashion, a plurality of items, said table comprising:

a body having a substantially planar base surface and a plurality of elevated and interconnected sides defining a basin therebetween which is capable of holding a volume of ice particles;

a plurality of elongated members secured to said body and extending downwardly therefrom; and a plurality of elevated members arranged in upwardly extending fashion from said planar base surface, each of said elevating members further comprising a plurality of elongate extending dividers terminating in upwardly facing surfaces capable of supporting the items at locations above said planar base surface;

wherein said elevating members maintain the items at an elevation above a water level created within said basin and upon said base surface, the water level resulting from melting of the ice particulates.

9. The portable refrigeration table as described in claim 8, further comprising said elevating members being incorporated into a removable mat dimensioned to fit upon said planar base surface.

10. The portable refrigeration table as described in claim 9, further comprising said removable mat having a selected shape and size and being constructed of a moisture impermeable and flexible material.

11. The portable refrigeration table as described in claim 8, further comprising said body being constructed of an injection molded flowable and plasticized material, a plurality of recessed channels being defined within said planar base surface and receiving, in fixedly engaging fashion, inserting ends of each of said dividers.

12. The portable refrigeration table as described in claim 11, said body further comprising an internally open and subterranean portion located underneath said base surface and a bottom facing surface of said body.

13. The portable refrigeration table as described in claim 11, each of said plurality of dividers further comprising an outwardly flared and dovetailed portion proximate at least one of said upwardly supporting and downwardly inserting ends.

* * * * *